US006709528B1

(12) United States Patent
Grubb et al.

(10) Patent No.: US 6,709,528 B1
(45) Date of Patent: Mar. 23, 2004

(54) SURFACE TREATMENTS TO IMPROVE CORROSION RESISTANCE OF AUSTENITIC STAINLESS STEELS

(75) Inventors: John F. Grubb, Lower Burrell, PA (US); James D. Fritz, Cabot, PA (US); Ronald E. Polinski, Murrysville, PA (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 09/633,508

(22) Filed: Aug. 7, 2000

(51) Int. Cl.[7] ..... C23G 1/02

(52) U.S. Cl. ..... 134/3; 134/6; 134/41; 420/584.1; 420/582; 420/586; 148/327

(58) Field of Search ..... 134/3, 6, 41; 148/580, 148/503, 506, 542, 582, 327; 420/584.1, 586, 582

(56) References Cited

U.S. PATENT DOCUMENTS

| | | | | |
|---|---|---|---|---|
| 3,776,784 A | * | 12/1973 | Rowe | 148/12 |
| 3,837,847 A | | 9/1974 | Bieber | |
| 3,895,940 A | | 7/1975 | Bieber | |
| 4,545,826 A | * | 10/1985 | McCunn et al. | 148/12 |
| 4,875,933 A | | 10/1989 | Wan | |
| 4,876,065 A | * | 10/1989 | Rockel et al. | 420/586 |
| 4,911,886 A | * | 3/1990 | Pitler et al. | 420/586 |
| 4,915,752 A | * | 4/1990 | Culling | 148/327 |
| 4,975,335 A | * | 12/1990 | Wan | 428/610 |
| 5,057,108 A | | 10/1991 | Shetty et al. | |
| 5,120,614 A | * | 6/1992 | Hibner et al. | 428/679 |
| 5,196,632 A | | 3/1993 | Larsen et al. | |
| 5,275,696 A | * | 1/1994 | Gaskin et al. | 156/664 |
| 5,673,473 A | | 10/1997 | Johnson et al. | |
| 5,695,716 A | * | 12/1997 | Kohler et al. | 420/584.1 |
| 5,743,968 A | * | 4/1998 | Leeker et al. | 134/2 |

OTHER PUBLICATIONS

Trent Sea–Cure Stainless Steel, p. 8, Figure 5.*
Stainless Steel Material Grade Composition Chart.*
John F. Grubb, "Pickling and Surface Chromium—Depletion of Corrosion–Resistant Alloys", Proceedings of International Conference on Stainless Steels, 1991.
J.F. Grubb and J.R. Maurer, "Correlation of the Microstructure of a 6% Molybdenum Stainless Steel with Performance in a Highly Aggressive Test Medium", The NACE International Annual Conference and Corrosion Show, 1995, Paper No. 300.

(List continued on next page.)

*Primary Examiner*—Randy Gulakowski
*Assistant Examiner*—Gentle E Winter
(74) *Attorney, Agent, or Firm*—Patrick J. Viccaro

(57) ABSTRACT

A method of enhancing the corrosion resistance of an austenitic steel includes removing material from at least a portion of a surface of the steel such that corrosion initiation sites are eliminated or are reduced in number relative to the number resulting from processing in a conventional manner. Material may be removed from the portion by any suitable method, including, for example, grit blasting, grinding and/or acid pickling under conditions more aggressive than those used in conventional processing of the same steel.

24 Claims, 12 Drawing Sheets

OTHER PUBLICATIONS

Jack R. Maurer and James W. Underkofler, "Optimizing a 6%Mo Stainless Steel for FGD Service", The NACE International Annual Conference and Corrosion Show, 1998, Paper No. 475.

D.S. Dunn, N. Sridhar, G.A. Cragnolino, "The Effect of Surface Conditions on the Localized Corrosion of a Candidate High–Level Nuclear Waste Container Material", Proceedings in the 12$^{th}$ International Corrosion Congress, Vol. 5B, pp. 4021–4030, 1993.

D.S. Dunn, N. Sridhar, G.A. Cragnolino, "Effects of Surface Chromium Depletion on Localized Corrosion of Alloy 825 as a High–Level Nuclear Waste Container Material", Corrosion Science—Aug. 1995, pp. 618–624.

D.S. Dunn, N. Sridhar, G.A. Cragnolino, "Effects of Surface Chromium Depletion on the Localized Corrosion of Alloy 825 as a High–Level Nuclear Waste Container Material", The Annual Conference and Corrosion Show Sponsored by NACE International, 1994, Paper No. 138.

H.D. Pletka, U. Reichau, K.G. Schütze, "Surface Treatment of Stainless Steels as a Corrosion Protection Measure", Progress in the Understanding and Prevention of Corrosion, vol. II, Barcelona, Spain, Jul. 1993, pp. 1101–1108.

* cited by examiner

Test Temperature = 32.2°C (90°F)

| Sample | Weight Loss (grams/cm$^2$) | Deepest Crevice | Remarks |
|---|---|---|---|
| 1 | 0.0000 | ~0.001" | Attack under 9 of 40 plateaus |
| 2 | 0.0001 | ~0.007"* | Attack under 11 of 40 plateaus |
| 3 | 0.0000 | Etch | Attack under 2 of 40 plateaus |
| 4 | 0.0000 | Etch | Attack under 2 of 40 plateaus |
| 5 | 0.0000 | -- | No apparent attack |
| 6 | 0.0000 | -- | No apparent attack |
| 7 | 0.0000 | ~0.004"* | Attack under 4 of 40 plateaus |
| 8 | 0.0000 | Lt Etch | Etch under 1 of 40 plateaus |
| 9 | 0.0000 | ~0.003"* | Attack under 11 of 40 plateaus |
| 10 | 0.0000 | ~0.007"* | Attack under 3 of 40 plateaus |
| 11 | 0.0000 | -- | No apparent attack |
| 12 | 0.0000 | -- | No apparent attack |
| 13 | 0.0000 | Etch | Etch under 1 of 40 plateaus |
| 14 | 0.0000 | ~0.001" | Attack under 8 of 40 plateaus |
| 15 | 0.0000 | Etch | Etch under 1 of 40 plateaus |
| 16 | 0.0000 | ~0.001" | Attack under 4 of 40 plateaus |
| 17 | 0.0000 | -- | No apparent attack |
| 18 | 0.0000 | Etch | Etch under 3 of 40 plateaus |

* Designates a failure

FIG. 1(a)

Test Temperature = 35°C (95°F)

| Sample | Weight Loss (grams/cm$^2$) | Deepest Crevice | Remarks |
|---|---|---|---|
| 1 | 0.0000 | ~0.003"* | Attack under 7 of 40 plateaus |
| 2 | 0.0001 | ~0.006"* | Attack under 10 of 40 plateaus |
| 3 | 0.0000 | ~0.003"* | Attack under 8 of 40 plateaus |
| 4 | 0.0000 | ~0.005"* | Attack under 6 of 40 plateaus |
| 5 | 0.0000 | ~0.002"* | Attack under 10 of 40 plateaus |
| 6 | 0.0000 | Etch | Etch under 2 of 40 plateaus |
| 7 | 0.0000 | ~0.001" | Attack under 9 of 40 plateaus |
| 8 | 0.0000 | ~0.002"* | Attack under 9 of 40 plateaus |
| 9 | 0.0028* | ~0.022"* | Attack under 38 of 40 plateaus |
| 10 | 0.0001 | ~0.011"* | Attack under 14 of 40 plateaus |
| 11 | 0.0000 | -- | No apparent attack |
| 12 | 0.0000 | ~0.001" | Attack under 3 of 40 plateaus |
| 13 | 0.0000 | ~0.002"* | Attack under 8 of 40 plateaus |
| 14 | 0.0000 | Etch | Etch under 1 of 40 plateaus |
| 15 | 0.0000 | ~0.002"* | Attack under 8 of 40 plateaus |
| 16 | 0.0000 | Etch | Etch under 3 of 40 plateaus |
| 17 | 0.0000 | Etch | Etch under 10 of 40 plateaus |
| 18 | 0.0000 | Etch | Etch under 4 of 40 plateaus |

* Designates a failure

FIG. 1(b)

Test Temperature = 38°C (100°F)

| Sample | Weight Loss (grams/cm$^2$) | Deepest Crevice | Remarks |
|---|---|---|---|
| 1 | 0.0007* | ~0.026"* | Attack under 7 of 40 plateaus |
| 2 | 0.0008* | ~0.023"* | Attack under 11 of 40 plateaus |
| 3 | 0.0001 | ~0.009"* | Attack under 15 of 40 plateaus |
| 4 | 0.0000 | ~0.005"* | Attack under 4 of 40 plateaus |
| 5 | 0.0000 | Etch | Etch under 2 of 40 plateaus |
| 6 | 0.0000 | ~0.003"* | Attack under 3 of 40 plateaus |
| 7 | 0.0000 | ~0.004" | Attack under 3 of 40 plateaus |
| 8 | 0.0000 | ~0.005"* | Attack under 6 of 40 plateaus |
| 9 | 0.0037* | ~0.029"* | Attack under 22 of 40 plateaus |
| 10 | 0.0007* | ~0.023"* | Attack under 10 of 40 plateaus |
| 11 | 0.0000 | <0.001" | Attack under 1 of 40 plateaus |
| 12 | 0.0000 | ~0.002" | Attack under 2 of 40 plateaus |
| 13 | 0.0000 | -- | No apparent attack |
| 14 | 0.0000 | -- | No apparent attack |
| 15 | 0.0000 | ~0.005"* | Attack under 6 of 40 plateaus |
| 16 | 0.0000 | -- | No apparent attack |
| 17 | 0.0000 | ~0.003" | Attack under 2 of 40 plateaus |
| 18 | 0.0000 | ~0.002" | Attack under 6 of 40 plateaus |

* Designates a failure

FIG. 1(c)

Test Temperature = 46°C (115°F)

| Sample | Weight Loss (grams/cm$^2$) | Deepest Crevice | Remarks |
|---|---|---|---|
| 1 | 0.0240* | ~0.055"* | Attack under 39 of 40 plateaus |
| 2 | 0.0152* | ~0.061"* | Attack under 40 of 40 plateaus |
| 3 | 0.0097* | ~0.033"* | Attack under 20 of 40 plateaus |
| 4 | 0.0103* | ~0.052"* | Attack under 40 of 40 plateaus |
| 5 | 0.0086* | ~0.043"* | Attack under 31 of 40 plateaus |
| 6 | 0.0120* | ~0.042"* | Attack under 34 of 40 plateaus |
| 7 | 0.0117* | ~0.053"* | Attack under 40 of 40 plateaus |
| 8 | 0.0240* | ~0.048"* | Attack under 40 of 40 plateaus |
| 9 | 0.0207* | ~0.045"* | Attack under 40 of 40 plateaus |
| 10 | 0.0152* | ~0.048"* | Attack under 40 of 40 plateaus |
| 11 | 0.0089* | ~0.041"* | Attack under 23 of 40 plateaus |
| 12 | 0.0115* | ~0.034"* | Attack under 38 of 40 plateaus |
| 13 | 0.0045* | ~0.045"* | Attack under 11 of 40 plateaus |
| 14 | 0.0058* | ~0.058"* | Attack under 18 of 40 plateaus |
| 15 | 0.0077* | ~0.032"* | Attack under 23 of 40 plateaus |
| 16 | 0.0087* | ~0.045"* | Attack under 23 of 40 plateaus |
| 17 | 0.0274* | ~0.047"* | Attack under 36 of 40 plateaus |
| 18 | 0.0172* | ~0.043"* | Attack under 40 of 40 plateaus |

* Designates a failure

FIG. 1(d)

Test Temperature = 38°C (100°F)

| Sample | Weight Loss (grams/cm$^2$) | Deepest Crevice | Remarks |
|---|---|---|---|
| 1 | 0.0000 | -- | No apparent attack |
| 2 | 0.0000 | Lt Etch | Etch under 1 of 40 plateaus |
| 3 | 0.0000 | -- | No apparent attack |
| 4 | 0.0000 | -- | No apparent attack |
| 5 | 0.0000 | -- | No apparent attack |
| 6 | 0.0000 | -- | No apparent attack |
| 7 | 0.0000 | -- | No apparent attack |
| 8 | 0.0000 | -- | No apparent attack |
| 9 | 0.0000 | Lt Etch | Etch under 1 of 40 plateaus |
| 10 | 0.0000 | -- | No apparent attack |
| 11 | 0.0000 | -- | No apparent attack |
| 12 | 0.0000 | -- | No apparent attack |
| 13 | 0.0000 | -- | No apparent attack |
| 14 | 0.0000 | -- | No apparent attack |
| 15 | 0.0000 | -- | No apparent attack |
| 16 | 0.0000 | -- | No apparent attack |
| 17 | 0.0000 | -- | No apparent attack |
| 18 | 0.0000 | -- | No apparent attack |

* Designates a failure

FIG. 3(a)

Test Temperature = 43°C (110°F)

| Sample | Weight Loss (grams/cm$^2$) | Deepest Crevice | Remarks |
|---|---|---|---|
| 1 | 0.0000 | -- | No apparent attack |
| 2 | 0.0000 | -- | No apparent attack |
| 3 | 0.0000 | -- | No apparent attack |
| 4 | 0.0000 | -- | No apparent attack |
| 5 | 0.0000 | -- | No apparent attack |
| 6 | 0.0000 | -- | No apparent attack |
| 7 | 0.0000 | -- | No apparent attack |
| 8 | 0.0000 | -- | No apparent attack |
| 9 | 0.0000 | -- | No apparent attack |
| 10 | 0.0000 | -- | No apparent attack |
| 11 | 0.0000 | -- | No apparent attack |
| 12 | 0.0000 | -- | No apparent attack |
| 13 | 0.0000 | -- | No apparent attack |
| 14 | 0.0000 | -- | No apparent attack |
| 15 | 0.0000 | -- | No apparent attack |
| 16 | 0.0000 | -- | No apparent attack |
| 17 | 0.0000 | -- | No apparent attack |
| 18 | 0.0000 | -- | No apparent attack |

* Designates a failure

FIG. 3(b)

Test Temperature = 46°C (115°F)

| Sample | Weight Loss (grams/cm$^2$) | Deepest Crevice | Remarks |
|---|---|---|---|
| 1 | 0.0000 | -- | No apparent attack |
| 2 | 0.0000 | -- | No apparent attack |
| 3 | 0.0000 | -- | No apparent attack |
| 4 | 0.0000 | -- | No apparent attack |
| 5 | 0.0000 | -- | No apparent attack |
| 6 | 0.0000 | -- | No apparent attack |
| 7 | 0.0000 | -- | No apparent attack |
| 8 | 0.0000 | -- | No apparent attack |
| 9 | 0.0000 | -- | No apparent attack |
| 10 | 0.0000 | -- | No apparent attack |
| 11 | 0.0000 | -- | No apparent attack |
| 12 | 0.0000 | -- | No apparent attack |
| 13 | 0.0000 | -- | No apparent attack |
| 14 | 0.0000 | -- | No apparent attack |
| 15 | 0.0000 | -- | No apparent attack |
| 16 | 0.0000 | -- | No apparent attack |
| 17 | 0.0000 | -- | No apparent attack |
| 18 | 0.0000 | -- | No apparent attack |

* Designates a failure

FIG. 3(c)

Test Temperature = 48.8°C (120°F)

| Sample | Weight Loss (grams/cm$^2$) | Deepest Crevice | Remarks |
|---|---|---|---|
| 1 | 0.0000 | -- | No apparent attack |
| 2 | 0.0000 | -- | No apparent attack |
| 3 | 0.0000 | -- | No apparent attack |
| 4 | 0.0000 | -- | No apparent attack |
| 5 | 0.0000 | -- | No apparent attack |
| 6 | 0.0000 | -- | No apparent attack |
| 7 | 0.0000 | -- | No apparent attack |
| 8 | 0.0000 | -- | No apparent attack |
| 9 | 0.0000 | -- | No apparent attack |
| 10 | 0.0000 | -- | No apparent attack |
| 11 | 0.0000 | -- | No apparent attack |
| 12 | 0.0000 | -- | No apparent attack |
| 13 | 0.0000 | -- | No apparent attack |
| 14 | 0.0000 | -- | No apparent attack |
| 15 | 0.0000 | -- | No apparent attack |
| 16 | 0.0000 | -- | No apparent attack |
| 17 | 0.0000 | -- | No apparent attack |
| 18 | 0.0000 | -- | No apparent attack |

* Designates a failure

FIG. 3(d)

SURFACE TREATMENTS TO IMPROVE CORROSION RESISTANCE OF AUSTENITIC STAINLESS STEELS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a method of treating austenitic stainless steels and articles fabricated from such steels. The present invention more particularly relates to a method of treating at least a portion of a surface of austenitic stainless steels and articles fabricated from such steels to enhance their corrosion resistance. The present invention also is directed to austenitic stainless steels and articles fabricated from such steels that are produced using the method of the invention. The invention finds application in, for example, the production of corrosion resistant strip, bars, sheets, castings, plates, tubings, and other articles from austenitic stainless steels.

2. Description of the Invention Background

The need for metals with high corrosion resistance has been addressed by the development of steels of various compositions. Articles fabricated from steels that are resistant to chloride pitting and crevice corrosion are especially important for service environments such as seawater and certain chemical processing industries. Cr—Mo stainless steels including approximately 6% molybdenum by weight, commonly referred to as superaustenitic alloys, were developed for use in these and other aggressive environments.

Generally, the corrosion resistance of stainless steels is controlled by the chemical composition of the surface presented to the environment. Open-air annealing, a heat-treating operation commonly used in the production of stainless steels, is known to produce a chromium-depleted layer near the metal surface, under a chromium-rich oxide scale. Failure to remove both of these surfaces is known to impair the corrosion performance of stainless steels. Mechanical processes, such as grit blasting or grinding, have been employed to remove the chromium-rich scale. The chromium-depleted layer is generally removed by chemical means, namely, by acid pickling. Generally, pickling involves immersing the steel in an acidic solution, commonly an aqueous solution of nitric acid ($HNO_3$) and hydrofluoric acid (HF), for a period of time, preferably much less than 60 minutes. To speed the pickling process the acidic solution may be at an elevated temperature, preferably a temperature at which the acidic solution is not highly volatile. It is generally known that pickling of highly corrosion-resistant stainless steels requires particular care and attention because these materials are known to pickle slowly, thereby making removal of the chromium-depleted layer difficult.

Heretofore, it has been thought desirable to pickle stainless steels using relatively dilute acid solutions. That has been the case because steel production facilities typically produce a variety of alloys, and many stainless alloys cannot withstand pickling with more aggressive pickling solutions or do not require more aggressive pickling solutions to remove the chromium depleted layer. Moreover, handling and disposing of stronger acidic solutions would require more strenuous industrial safety and environmental controls. Thus, pickling using a relatively dilute, non-aggressive, pickling solution has been used to enhance corrosion resistance of stainless steels. It has been thought that providing a stainless steel with corrosion properties that are further enhanced relative to a particular pickled stainless steel requires modifying the alloy composition. Thus, for example, increasing chromium and/or molybdenum content of a particular stainless steel has been used to improve the steel's corrosion resistance. However, increasing the content of chromium, molybdenum, and other corrosion-enhancing alloying additions in a stainless steel increases alloying costs and may require changes to the manufacturing process. Thus, it would be desirable to provide a method of enhancing the corrosion resistance of stainless steels without modifying the chemical composition of the steels.

SUMMARY OF THE INVENTION

The present invention provides a method of enhancing the corrosion resistance of austenitic stainless steels and articles produced from the steels. The method includes removing sufficient material from at least a portion of a surface of the steel such that corrosion initiation sites present on the surface are eliminated or are reduced in number to an extent greater than has heretofore been achieved in conventional austenitic stainless steel processing. Removal of material from the steel surface may be accomplished by any known method suitable for removing material from a surface of a steel. Such methods include, for example, grit blasting, grinding, and/or acid pickling. Acid pickling, for example, occurs under conditions that are aggressive (stronger pickling solution and/or longer pickling time, for example) relative to conventional pickling conditions for the same steel. Applying the method of the invention in the production of a particular austenitic stainless steel provides corrosion resistance superior to that of a steel of the same chemical composition that has been processed in a conventional manner.

The method of the invention may provide austenitic stainless steels having a critical crevice corrosion temperature ("CCCT"), as defined herein, of at least around 13.5° C. greater than steels of the same composition that have been pickled and otherwise processed in a conventional manner. For a 6% molybdenum austenitic stainless steel such as UNS N08367 (commercially available as AL-6XN® and AL-6XN PLUS™ from Allegheny Ludlum Corporation, Pittsburgh, Pa.), a 13.50° C. increase in CCCT is equivalent to at least about a 4 weight percent increase in chromium content or a 1.2 weight percent increase in molybdenum content. The method of the present invention obviates the significant increase in cost, and also the concerns over phase stability, that would be associated with such increases in alloying additive content.

The present invention, therefore, provides an economical way of significantly improving the corrosion resistance properties of austenitic stainless steels, without changing the chemical composition of the steels.

BRIEF DESCRIPTION OF THE FIGURES

The advantages of the present invention can be better understood by reference to the accompanying Figures in which:

FIGS. 1(*a*)–(*d*) illustrate the results of a bolted multiple crevice test, the TC Cor 2 crevice test defined herein, performed at various temperatures on a UNS N08367 alloy manufactured and acid cleaned in a conventional manner;

FIGS. 3(*a*) through 3(*d*) illustrate the results of a bolted multiple crevice test, the TC Cor 2 crevice test defined herein, performed at various temperatures on a UNS N08367 alloy after undergoing a treatment that enhances corrosion resistance and which is an embodiment of the method of the present invention;

DETAILED DESCRIPTION OF THE INVENTION

Figure 2:
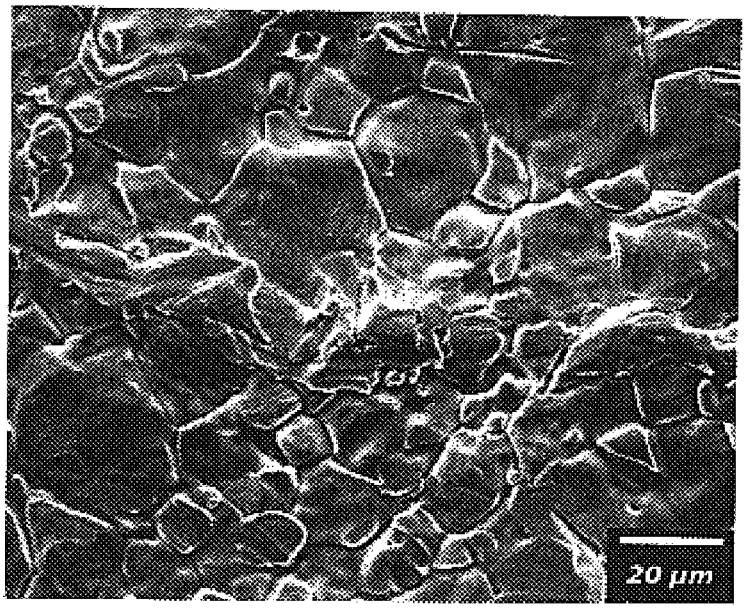
FIG. 2 is a scanning electron micrograph of a surface of a UNS N08367 alloy manufactured and acid cleaned in a conventional manner.

The present invention provides a method of enhancing the corrosion resistance of austenitic stainless steels and articles produced from the steels. The method includes removing sufficient material from at least a portion of a surface of the steel such that corrosion initiation sites present on the surface are eliminated or are reduced in number to an extent greater than has heretofore been achieved in conventional austenitic stainless steel processing. Removal of material from the steel surface may be accomplished by any of a variety of methods, including grit blasting, grinding, and/or acid pickling. The method of the invention provides improvement in the corrosion resistance of a steel without the need to modify the steel's chemical composition. The method may be applied on austenitic stainless steel in any form, including strip, bar, plate, sheet, casting, tube, and other forms.

The following test results applying the invention to UNS N08367 stainless steel, an austenitic stainless steel containing approximately 6 weight percent molybdenum, amply illustrates the advantages provided by the present invention. The invention, however, is not so limited. Without intending to be bound by any particular theory of operation, the present inventors believe that the method of the present invention enhances corrosion resistance by eliminating or reducing in number sites on the surface of a steel at which corrosion may be initiated. It is believed enhancement in corrosion resistance of any austenitic stainless steel would be achieved by applying the present method in the production or post-production treatment of that steel. Thus, the fact that only certain embodiments of the present invention are described herein should not be considered to in any way limit the invention, and the true scope of the invention is as provided in the appended claims.

The present invention is especially beneficial for enhancing the corrosion resistance of austenitic stainless steels that will be used in particularly corrosive environments. Austenitic stainless steels used in such applications typically are comprised of, by weight, 20 to 40% nickel, 14 to 24% chromium, and 4 to 12% molybdenum. The composition of one such steel, UNS N08367, which is considered in the following tests, is set forth in Table 1.

TABLE 1

UNS N08367 Chemical Composition

| Chemical Element | Typical (Wt %) | ASTM/ASME (Wt %) |
|---|---|---|
| C | 0.02 | 0.03 max |
| Mn | 0.40 | 2.00 max |
| P | 0.02 | 0.04 max |
| S | <0.001 | 0.03 max |
| Si | 0.40 | 1.00 max |
| Cr | 20.5 | 20.00–22.00 |
| Ni | 24.0 | 23.50–25.50 |
| Mo | 6.20 | 6.00–7.00 |
| N | 0.22 | 0.18–0.25 |
| Cu | 0.20 | 0.75 max |
| Fe | Balance | Balance |

The relative pitting resistance of a stainless steel can be correlated to alloy composition using the Pitting Resistance Equivalent number ($PRE_N$). The $PRE_N$ provides a prediction, based on composition, of the resistance of a stainless alloy to chloride-induced localized corrosion attack. Although several equations for calculating $PRE_N$ have been described, a widely accepted equation is Equation 1 below:

$$(PRE_N)=(\text{wt. \% Cr})+3.3\ (\text{wt. \% Mo})+30\ (\text{wt. \% N}) \qquad \text{Equation 1:}$$

Thus, the typical UNS N08367 composition shown in Table 1 has a $PRE_N$ of 47.5, while the maximum $PRE_N$ of a UNS N08367 alloy is 52.6.

To compare the difference in the corrosion resistance capabilities of a UNS N08367 alloy processed in a conventional manner with the same alloy that has undergone a treatment that is within the method of the present invention, alloy samples were tested to measure CCCT utilizing a TC Cor 2 crevice test. This test is often specified when steel products are being qualified for severely corrosive applications. The TC Cor 2 test is a bolted multiple crevice test which will be generally familiar to one of ordinary skill. The TC Cor 2 test, in particular, entails exposing a steel sample to a 10% $FeCl_3.6H_2O$ solution for an exposure time of 72 hours. Delrin washers, in accordance with the ASTM G78 specification, are bolted to the test sample to create artificial crevices on the sample surface. All TC Cor 2 testing used herein was performed after applying a torque of 58 inch-lbs to fasten the washers to the samples surfaces. To determine the threshold temperature for crevice attack, samples were tested over a range of temperatures. With plate samples, crevice attack is considered present if the weight loss of the sample is greater than 0.0002 grams/$cm^2$ or if the depth of corrosive attack is greater than 0.0015 inches.

Historically, the expected results of the TC Cor 2 for austenitic stainless steels could be predicted based on alloy composition. Equation 2, set forth below, is one equation for predicting the CCCT results of TC Cor 2 tests based on alloy composition.

$$\text{CCCT}(^\circ\text{ C.})=3.2\ (\text{wt. \% Cr})+7.6\ (\text{wt. \% Mo})+10.5\ (\text{wt. \% N})-88.5 \qquad \text{Equation 2:}$$

This equation is similar to the equation described in the ASTM G48 specification, but is modified to account for the fact that TC Cor 2 test is slightly more aggressive than the crevice test described in the ASTM Method D specification. Thus, according to Equation 2, a UNS N08367 alloy having a $PRE_N$ of 47.5 would be expected to have a CCCT of 27° C. (80.6° F.).

TC Cor 2 crevice testing was performed on samples of UNS N08367 steel processed in a conventional manner, including a mill anneal and an acid cleaning under typical processing conditions. The results of the TC Cor 2 testing, at temperatures ranging from 32.2° C. (90° F.) to 46° C. (115° F.) are set forth in FIGS. 1(*a*) through 1(*d*). As expected, failures were experienced at all temperature measurements, including those conducted at temperatures as low as 32.2° C. (90° F.). Those results are consistent with what would be expected by the results of Equation 2, above.

FIG. 2 illustrates the surface of a UNS N08367 steel processed in a conventional manner. The corrosive attack on the surface of a conventionally produced sample, after undergoing ASTM G 150 test, is seen in the SEM of FIG. 5. The typical as-received mill surface seen in FIG. 5 appears to have a very active surface condition present on the surface of the steel. The morphology of this attack suggests that this more active surface condition may serve as the weak link in the corrosion resistance of the alloy.

FIGS. 3(*a*) through 3(*d*) illustrates the improved corrosion resistance achieved according to an embodiment of the method of the present invention. According to the embodiment, the typical as-received mill steel surface was sandblasted and then lightly pickled with a relatively weak acid and short exposure time. The pickling solution was 10.02% $HNO_3$/1.16% HF (as used herein, % acid=[grams of acid/100 ml solution]), the pickling solution temperature was 140° F., and the steel was exposed to the solution for 3 minutes. As is apparent, this surface treatment produced substantial improvement in corrosion performance over specimens that were only acid cleaned. The sandblasted and pickled specimens passed the TC Cor 2 crevice test at 48.8° C. (120° F.), which is the highest temperature that was evaluated and which is well above 27° C. (80.6° F.), the CCCT result predicted by Equation 2 for a steel having the composition of UNS N08367 steel.

Figure 4:
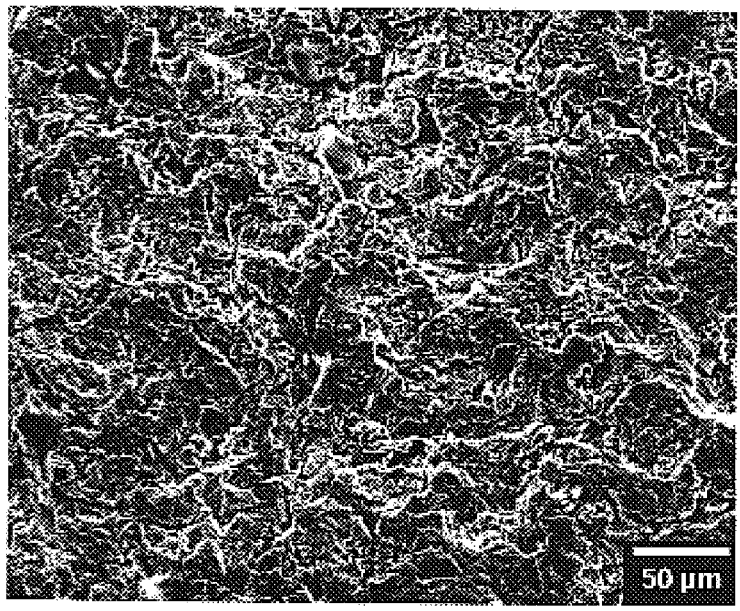
FIG. 4 is a scanning electron micrograph (SEM) of a surface of a UNS N08367 alloy after undergoing a treatment that enhances corrosion resistance and which is an embodiment of the method of the present invention.
Figure 5A:
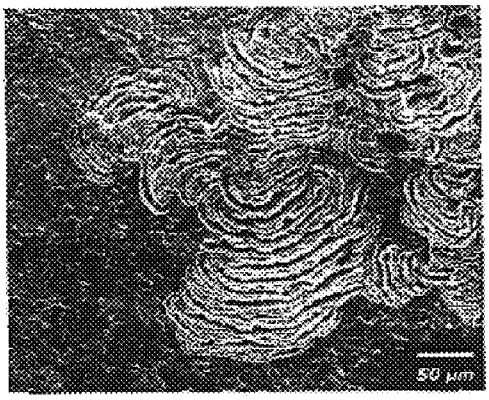
FIG. 5 is an SEM of a surface of a UNS N08367 alloy manufactured and acid cleaned in a conventional manner after undergoing the ASTM G 150 test.
Figure 5B:
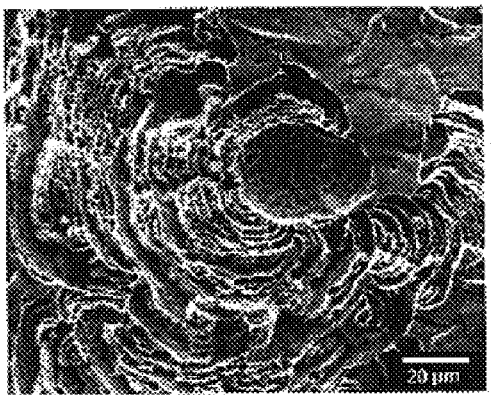
Figure 5C:
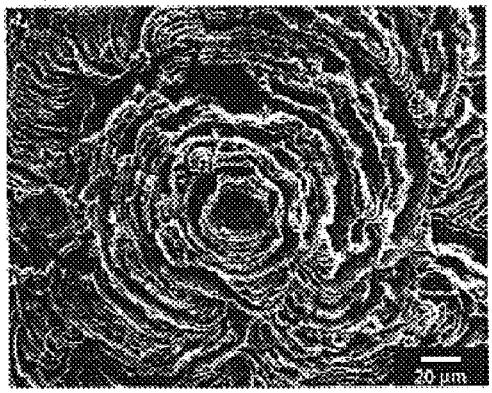
Figure 5D:
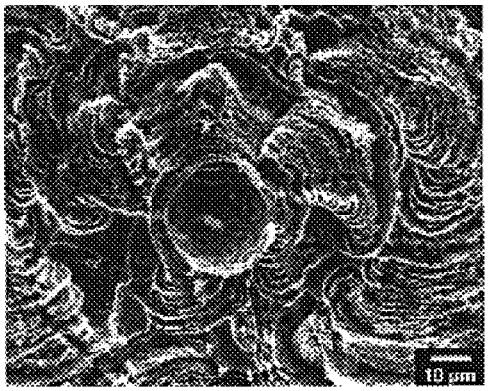

As is apparent in FIG. 4, the surface of the sandblasted and pickled surface is completely abraded with no evidence of the former mill-pickled surface. The inventors do not wish to be bound by any particular theory of how the present invention enhances corrosion resistance. However, the results shown in FIG. 4 suggest that the improved corrosion resistance produced by grit blasting may be related to the removal of corrosion initiation sites present on the original mill surface.

Additional testing of the improved corrosion resistance achieved by the present invention was conducted using the ASTM G 150 test procedure for determining the electrochemical critical pitting temperature ("ECPT"). The ECPT is a sensitive method of ranking an alloy's resistance to chloride pitting. The test includes holding steel samples at a constant potential of 700 mV (vs. SCE) while the temperature of the specimen and test solution are increased at a rate of 1° C. per minute. The measurements reported herein were performed in a Gamry Flex Cell using the Gamry CMS 110 Critical Pitting Test System. The electrolyte used in the testing consisted of 1M NaCl and the cell was purged with 99.99% nitrogen gas during testing. The ECPT is defined as the temperature at which the current increases above 100 $\mu A/cm^2$ and stays above this threshold current density for 60 seconds.

Samples of the UNS N08367 alloy were tested for ECPT after receiving either (1) typical acid cleaning, (2) sandblasting and pickling (with a 10.02% $HNO_3$/1.16% HF solution at 140° F. for 3 minutes), or (3) grinding (240 grit) and acid cleaning. The results are illustrated in Table 2.

TABLE 2

ECPT Test Results

| Surface Treatment | ECPT |
|---|---|
| Acid Cleaned | 173° F. (78.5° C.) |
| Sandblasted and Pickled | 184° F. (84.5° C.) |
| Ground and Acid Cleaned | 191° F. (88.2° C.) |

These results parallel the TC Cor 2 crevice corrosion results. The acid cleaned mill surface shows the least resistance (lowest ECPT). On the other hand, if the mill surface is grit blasted and pickled or ground and acid cleaned, the corrosion resistance is improved. The samples used to obtain the ECPT results were examined by a scanning electron microscope to see if the initiation sites for corrosive attack could be identified. The attack on the surface of the acid cleaned sample is shown in FIG. 5. Here, the initiation sites consist of regions that are preferentially attacked, thereby resulting in a very unusual etch pattern. The morphology of the attack suggests the presence of a more active surface condition that serves as the weak link in the corrosion resistance of the steel.

Figure 6A:
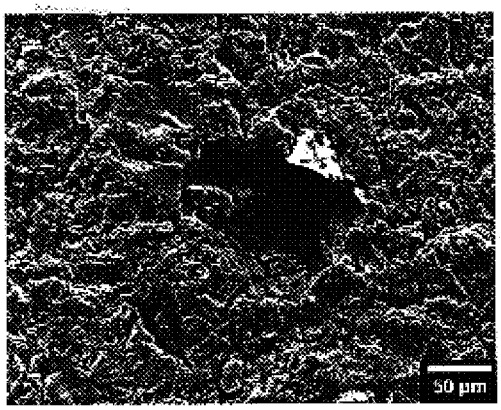
FIG. 6 is an SEM of a surface of a UNS N08367 alloy after undergoing a treatment that enhances corrosion resistance and which is an embodiment of the method of the present invention, and after being subjected to the ASTM G 150 test.
Figure 6B:
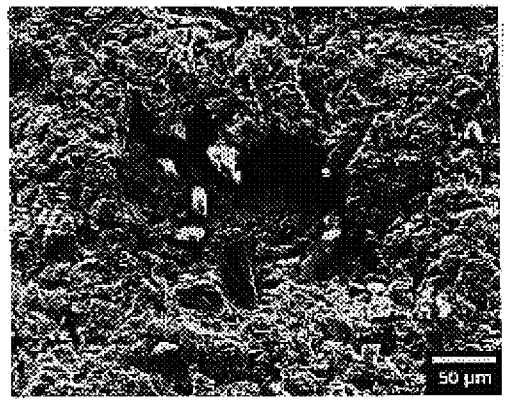
Figure 7A:
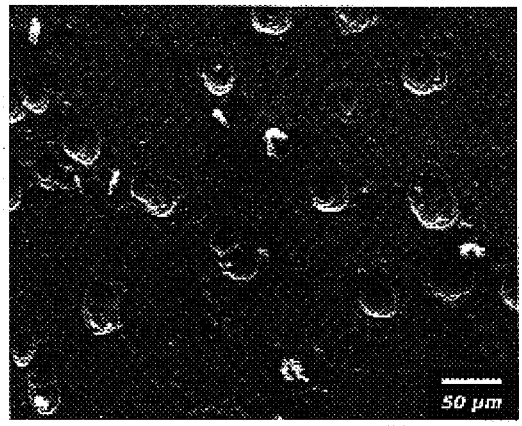
FIG. 7 is an SEM of a surface of a UNS N08367 alloy after undergoing a treatment that enhances corrosion resistance and which is an embodiment of the method of the present invention, and after being subjected to the ASTM G 150 test.
Figure 7B:
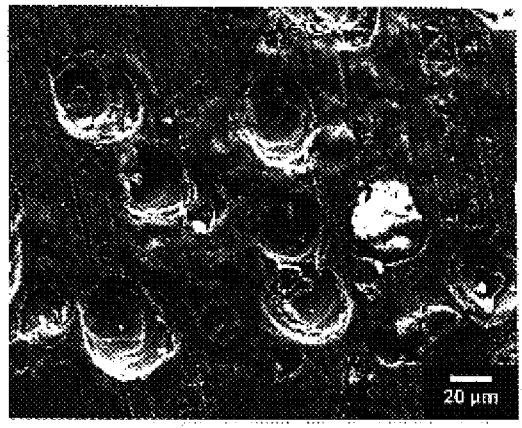

The sites for corrosion attack on the surface of a steel treated according to one embodiment of the present invention, wherein the surface was sandblasted and pickled, are shown in FIG. 6. As is apparent, these sites consist of isolated angular pit-like cavities. The SEM of the surface of a steel treated according to another embodiment of the invention is shown in FIG. 7. As FIG. 7 illustrates, the surface of the ground and acid-cleaned specimen has spherical pitting widely distributed across the surface of the specimen. The reason for the wide spread pitting on this specimen is because this sample was exposed to higher temperatures which nucleated many more sites of attack.

These results show that the morphology of attack depends on the steel's surface treatment. The typically produced steel surface appears to have a very active surface condition present that may be a weak link in the corrosion resistance of the steel. When this surface condition is attacked it produces very unusual etch patterns which resemble a series of concentric rings. Sandblasting and grinding are two ways of removing this surface condition. The inventors have shown that removing or decreasing the occurrence of that surface condition by the method of the present invention provides the treated surface with corrosion resistance that is enhanced relative to that achieved by processing the steel in a conventional manner.

Although, as illustrated above, sandblasting and/or grinding can be used to enhance the corrosion properties of steels, as illustrated above, these operations may have a substantial impact on production cost and delivery time. Therefore, the use of a relatively aggressive pickling operation was considered to determine whether improved corrosion resistance would be achieved. Several experiments were carried out using various pickling solutions and exposure times. Although all such testing was carried out using an acidic aqueous solution including $HNO_3$ and HF, it is expected that other acids, such as, for example, $H_2SO_4$ and HCl, could be used in the pickling solution in accordance with the present invention. As can be seen from the results of the TC Cor 2 testing set forth in Table 3 below, a short-term pickle in a mild solution (10.02% $HNO_3$/1.16% HF solution at 140° F. for 3 minutes) will not significantly improve the corrosion resistance.

TABLE 3

TC Cor 2 Test - Short Term/Mild Pickling
Test Temperature = 46° C. (115° F.)

| Sample | Weight Loss (grams/cm$^2$) | Deepest Crevice | Remarks |
|---|---|---|---|
| 1 | 0.0149* | ≅0.048"* | Attack under 37 of 40 plateaus |
| 2 | 0.0215* | ≅0.074"* | Attack under 39 of 40 plateaus |
| 3 | 0.0085* | ≅0.030"* | Attack under 36 of 40 plateaus |
| 4 | 0.0132* | ≅0.038"* | Attack under 31 of 40 plateaus |
| 5 | 0.0078* | ≅0.035"* | Attack under 33 of 40 plateaus |
| 6 | 0.0124* | ≅0.050"* | Attack under 38 of 40 plateaus |
| 7 | 0.0097* | ≅0.039"* | Attack under 40 of 40 plateaus |
| 8 | 0.0200* | ≅0.063"* | Attack under 39 of 40 plateaus |

*Designates a failure

Each sample listed in Table 3 failed the TC Cor 2 test at a temperature of 46° C. (115° F.). This is expected from Equation 2, which, for the UNS N08367 alloy, predicts a CCCT of only 27° C. (80.6° F.).

The TC Cor 2 test was then conducted under pickling conditions more aggressive than those conditions used when processing the material in a conventional manner. The experimental results are summarized in Table 4.

TABLE 4

TC Cor 2 Test Results: Varying Pickling Conditions

| Sample | Pickling Solution* | Pickling Temperature | Pickling Time | CCCT Result |
|---|---|---|---|---|
| 1 | 7.2% $HNO_3$/3.4% HF | 140° F. | 20 min | CCCT < 43° C. |
| 2 | 7.2% $HNO_3$/3.4% HF | 140° F. | 40 min | CCCT < 43° C. |
| 3 | 7.2% $HNO_3$/3.4% HF | 140° F. | 120 min | CCCT = 43° C. |
| 4 | 7.2% $HNO_3$/3.4% HF | 140° F. | 420 min | CCCT = 46° C. |
| 5 | 4% $HNO_3$/5.5% HF | 143° F. | 30 min | CCCT = 40.5° C. |
| 6 | 4% $HNO_3$/7.1% HF | 147° F. | 30 min | CCCT = 38° C. |
| 7 | 4% $HNO_3$/7.1% HF | 150° F. | 30 min | CCCT = 43° C. |
| 8 | 14% $HNO_3$/2.3% HF | 140° F. | 60 min | CCCT = 40.5° C. |
| 9 | 14% $HNO_3$/2.3% HF | 140° F. | 360 min | CCCT = 46° C. |
| 10 | 10% $HNO_3$/6% HF | 140° F. | 15 min | CCCT < 46° C. |
| 11 | 10% $HNO_3$/6% HF | 140° F. | 30 min | CCCT < 46° C. |
| 12 | 10% $HNO_3$/8% HF | 140° F. | 15 min | CCCT < 46° C. |
| 13 | 10% $HNO_3$/8% HF | 140° F. | 30 min | CCCT < 46° C. |
| 14 | 10% $HNO_3$/10% HF | 140° F. | 15 min | CCCT < 46° C. |
| 15 | 10% $HNO_3$/10% HF | 140° F. | 30 min | CCCT < 46° C. |

*% acid = [(grams of acid)/(100 ml solution)] × 100

The enhancement of corrosion resistance resulting from the aggressive pickling is apparent. The various combinations of pickling time, temperature, and bath chemistry included in Table 4 provided the pickled samples with CCCT values well above the 27° C. result predicted by Equation 2 for a UNS N08367 alloy having a typical $PRE_N$ of 47.5 (equation 2 predicts a CCCT of 37.7° C. for the N08367 alloy at the maximum composition range for Cr, Mo, and N). Some samples achieved CCCT values as high as 38° C., 40.5° C., 43° C. (110° F.) and 46° C. (115° F.), a substantial increase in pitting resistance relative to the expected value. Based on the above equations, a predicted 13.5–20° C. increase in CCCT could be achieved by modifying the composition of the UNS N08367 alloy to include an additional 4 weight % chromium or, alternatively, an additional 1.2 weight % molybdenum. Beyond the cost implications of such alloying additions, enhancing corrosion resistance of the UNS N08367 alloy by the foregoing alloying additions would not be practical due to the phase instability that would result.

Figure 8:
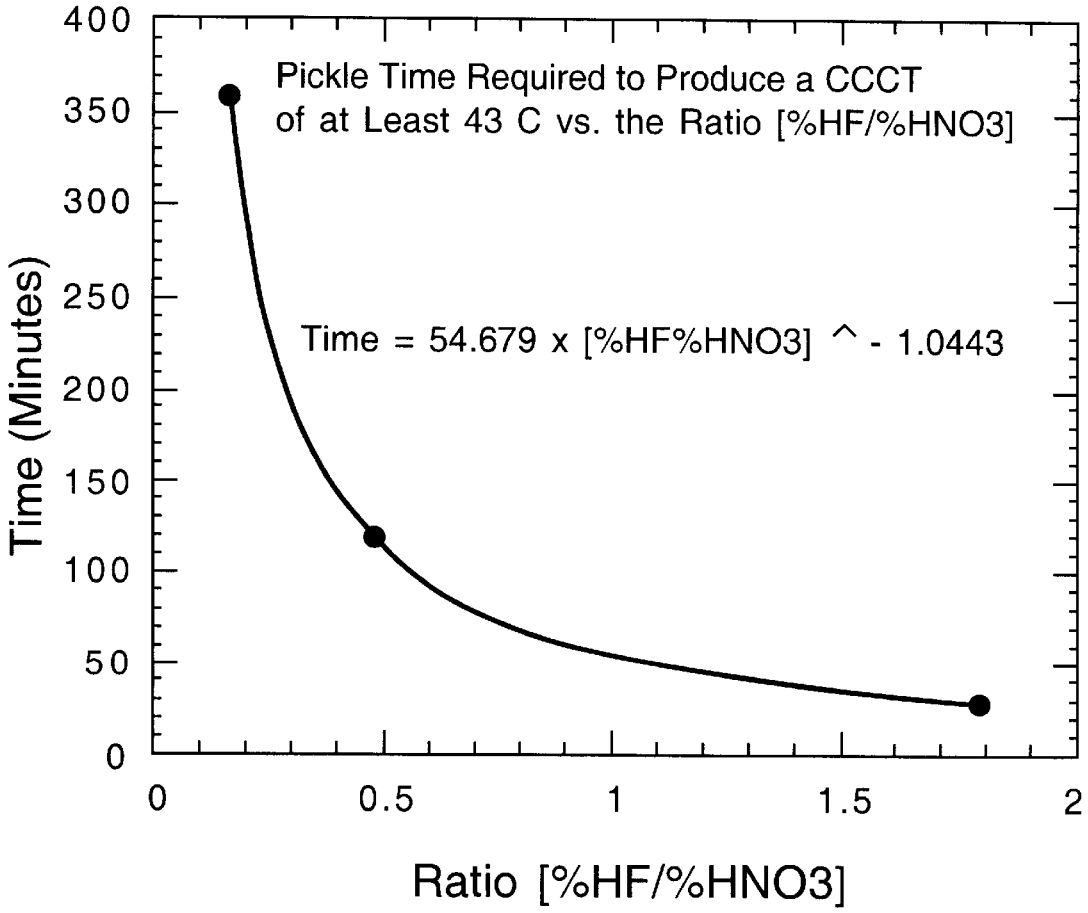
FIG. 8 is a plot of the pickling time, in minutes, required to achieve a CCCT of at least 43° C. (110° F.) relative to the weight % ratio of HF to $HNO_3$ in the pickling solution.

To further investigate the present method, the pickling time required to achieve at least a CCCT of 43° C. (110° F.) was plotted as a function of the weight % ratio of HF to $HNO_3$ in the pickling solution. The resulting plot is shown in FIG. 8. This plot shows that the pickle time required to enhance the corrosion resistance is indirectly proportional to the ratio of the weight % HF to weight % $HNO_3$ in the pickling bath. In particular, the minimum pickling time, in minutes, required to achieve a CCCT of at least 43° C. (110° F.) is approximately equal to $55(x)^{-1.0443}$, where (x) is the weight ratio of HF to $HNO_3$ in the pickling solution. It is expected that similar plots can be developed for use with different bath chemistries.

The present invention may be used with any austenitic stainless steel to enhance the corrosion resistance of the steel relative to the corrosion resistance achieved by processing the steel in a conventional manner. For example, the above data shows that the actual corrosion resistance of samples of an austenitic stainless steel treated by the method of the present invention is significantly greater than that of the same steel processed using a conventional acid treatment. Thus, the present method may be used to provide austenitic stainless steels, and articles fabricated from those steels, which have corrosion resistance properties not previously achieved in steel with the same chemical composition. The method of the invention may be used with articles of any type fabricated from austenitic stainless steels. Such articles include, for example, strip, bars, plates, sheets, castings, and tubing.

It is to be understood that the present description illustrates aspects of the invention relevant to a clear understanding of the invention. Certain aspects of the invention that would be apparent to those of ordinary skill in the art and that, therefore, would not facilitate a better understanding of the invention may not have not been presented in order to simplify the present description. Although the present invention has been described in connection with certain embodiments, those of ordinary skill in the art will, upon considering the foregoing description, recognize that many modifications and variations of the invention may be employed. The foregoing description and the following claims are intended to cover all such variations and modifications of the invention.

What is claimed is:

1. A method for enhancing the corrosion resistance of an austenitic stainless steel having the composition of UNS N08367 and a first critical crevice corrosion temperature that is no more than 5° C. greater than x, where x is based on the composition of the steel and x(° C.)=3.2 (weight % Cr)+7.6 (weight % Mo)+10.5 (weight % N)−88.5, the method comprising pickling at least a portion of a surface of the steel by an acid pickling, wherein sufficient material is removed from the portion of the surface of the steel during pickling such that after pickling the pickled portion of the surface has a second critical crevice corrosion temperature that is at least 16° C. greater than x.

2. The method of claim 1 wherein the second critical crevice corrosion temperature is at least 46° C.

3. The method of claim 1 wherein said steel is in the form of an article selected from the group consisting of strip, bar, plate, sheet, casting, and tubing.

4. The method of claim 1 wherein pickling at least a portion of a surface of the steel reduces the number of corrosion initiation sites.

5. The method of claim 1, wherein the acid pickling is carried out in a solution comprising at least one acid selected from the group consisting of nitric acid, hydrofluoric acid, sulfuric acid, and hydrochloric acid.

6. The method of claim 5 wherein the acid pickling is carried out in an aqueous solution comprising nitric acid and hydrofluoric acid.

7. The method of claim 6 wherein the duration of contact between the aqueous solution and the austenitic stainless steel is equal to or greater than $55(R)^{-1.0443}$ minutes wherein R is the weight ratio of hydrofluoric acid to nitric acid in the aqueous solution.

8. The method of claim 1 wherein the duration of the acid pickling is no more than 60 minutes.

9. The method of claim 6 wherein the temperature of the solution is at least 140° F.

10. The method of claim 6 wherein the duration of contact between the aqueous solution and the steel is no more than 30 minutes and the second critical crevice corrosion temperature is at least 43° C.

11. The method of claim 1 wherein the second critical crevice corrosion temperature is at least 19° C. greater than x.

12. The method of claim 1 wherein the second critical crevice corrosion temperature is at least 43° C.

13. The method of claim 7 wherein R ranges from 0.1 to 2.

14. A method for improving the corrosion resistance of an austenitic stainless steel article, the method comprising:

producing an article comprising an austenitic stainless steel having the composition of UNS N08367 and a first critical crevice corrosion temperature that is no more than 5° C. greater than x, wherein x is based on the composition of the steel and x(° C.)=3.2 (weight % Cr)+7.6 (weight % Mo)+10.5 (weight % N)−88.5; and pickling at least a portion of a surface of the steel by an acid pickling wherein sufficient material is removed form the portion of the surface of the steel during pickling such that the pickled portion of the surface has a second critical crevice corrosion temperature that is at least 16° C. greater than x.

15. The method of claim 14 wherein the second critical crevice corrosion temperature is at least 46° C.

16. The method of claim 14 wherein the second critical crevice corrosion temperature is at least 19° C. greater than x.

17. The method of claim 14 wherein the second critical crevice corrosion temperature is at least 43° C.

18. A method for enhancing the corrosion resistance of an austenitic stainless steel comprising:

providing an austenitic stainless steel having a composition of UNS N08367; and pickling at least a portion of a surface of the austenitic stainless steel by acid pickling, wherein sufficient material is removed from the portion of the surface of the steel during pickling such that after pickling the pickled portion of surface has a critical crevice corrosion temperature that is at least 10° C. greater than a critical crevice corrosion temperature of the portion of the surface immediately prior to pickling.

19. The method of claim 18 wherein the pickled portion of the surface has a critical crevice corrosion temperature that is at least 16° C. greater than the critical crevice corrosion temperature of the portion of the surface immediately prior to pickling.

20. The method of claim 18 wherein the critical crevice corrosion temperature of the pickled portion of the surface is at least 46° C.

21. The method of claim 18 wherein pickling the portion of the surface of the steel by acid pickling comprises a single pickling treatment.

22. The method of claim 18 wherein the acid pickling is carried out in an aqueous solution comprising nitric acid and hydrofluoric acid.

23. The method of claim 22 wherein the duration of contact between the aqueous solution and the steel is no more than 30 minutes and the critical crevice corrosion temperature of the pickled portion of the surface is at least 43° C.

24. The method of claim 22 wherein the duration of contact between the aqueous solution and the steel is equal to or greater than $55(R)^{-1.0443}$ minutes, wherein R is the weight ratio of hydrofluoric acid to nitric acid in the aqueous solution and ranges from 0.1 to 2.

* * * * *

UNITED STATES PATENT AND TRADEMARK OFFICE

CERTIFICATE OF CORRECTION

PATENT NO. : 6,709,528 B1 
DATED : March 23, 2004
INVENTOR(S) : John F. Grubb, James D. Fritz and Ronald E. Polinski It is certified that error appears in the above-identified patent and that said Letters Patent is hereby corrected as shown below:

Column 9,
Line 36, delete "form" and substitute therefore -- from --.

Signed and Sealed this

Eighteenth Day of January, 2005

JON W. DUDAS
*Director of the United States Patent and Trademark Office*